United States Patent [19]

Dotson

[11] 4,427,236

[45] Jan. 24, 1984

[54] IN-SITU URANIUM LEACHING

[75] Inventor: Billy J. Dotson, Grand Prairie, Tex.

[73] Assignee: Mobil Oil Corporation, New York, N.Y.

[21] Appl. No.: 293,785

[22] Filed: Aug. 18, 1981

[51] Int. Cl.[3] ..... E21B 43/28; E21C 41/14

[52] U.S. Cl. ..... 299/5; 166/281

[58] Field of Search ..... 299/4, 5; 166/281

[56] References Cited

U.S. PATENT DOCUMENTS 3,309,140 3/1967 Gardner et al. ..... 299/4

3,612,179 10/1971 Anderson et al. ..... 166/281

3,860,289 1/1975 Learmont ..... 299/4

4,085,971 4/1978 Jacoby ..... 299/4

*Primary Examiner*—Ernest R. Purser

*Attorney, Agent, or Firm*—Alexander J. McKillop; James F. Powers, Jr.; John K. AboKhair

[57] ABSTRACT

The present invention relates to a method for improving the recovery of mineral values from ore bodies subjected to in-situ leaching by controlling the flow behavior of the leaching solution. Foam is introduced into the higher permeability zones of the ore body to act as a diverting agent forcing the leaching fluids into the lower permeability previously non-contacted areas resulting in increased mineral values recovery.

12 Claims, No Drawings

IN-SITU URANIUM LEACHING

BACKGROUND OF THE INVENTION

1. Field of the Invention

The present invention relates to a method for improving the recovery of mineral values from ore bodies subjected to in-situ leaching by controlling the flow behavior of the leaching solution. More particularly, the present invention relates to an in-situ leaching operation employing a foam for mobility control of the leaching solution.

2. Description of the Art

The in situ leaching of mineral values from subterranean deposits is well-known in the art as a practical and economical means for recovering certain elements such as uranium, copper, nickel, molybdenum, rhenium, vanadium and the like. Basically, solution mining is carried out by injecting into the subterranean deposit, a leaching solution which will solubilize the mineral value desired to be recovered and the solution and solubilized mineral values are recovered from the deposit for subsequent separation of the mineral values. Often it is necessary to oxidize the mineral vale to a form where it can form a soluble reaction product in the leaching solution. Depending upon the nature of the subterranean deposit, the typical leaching solution may be an acid, for example, an aqueous sulfuric acid solution or may comprise an alkaline carbonate solution.

The above method, and modifications thereof, works most efficiently when a fairly uniform formation is the subject of the leaching process. All too often, however, and in fact in a majority of cases, the formations are not uniform as to both porosity and permeability. In some zones, the strata are sufficiently heterogeneous as to severely alter flow patterns. Leaching fluids follow the higher permeability streaks thus by-passing portions of the ore body which results in loss of recoverable mineral values due to the lack of contact by leaching fluids.

Foams have been used in petroleum recovery as indicated by U.S. Pat. No. 3,599,715 to Roszelle and U.S. Pat. No. 3,893,511 to Root which show two processes where foam is used for petroleum recovery. In the oil recovery process, the foaming agent, which is normally a surfactant, is of similar material present in the surfactant flooding process. When oil contacts with a foaming agent, then either some oil dissolves in the foaming agent or the oil solubilizes some of the foaming agent. In either case foaming agent loss is realized. In the mineral values leaching process of the present invention, the foam is used solely as a blocking agent without any chemical loss to the leaching solution or residual mineral values. Another difference is that in the oil recovery process, the foaming agent is usually introduced into the formation with another surfactant. The compatability of the two components is not at question. In the mineral values leaching process the foaming agent is introduced with a leaching solution which is of a substantially different chemical composition than the surfactant slug used in oil recovery processes.

It is an object of the present invention to provide an improved in-situ leaching process for formations having substantially non-uniform permeabilities.

SUMMARY OF THE INVENTION

In accordance with the present invention, there is provided a new and improved process for the recovery of mineral values from subterranean deposit by employing foams to control the mobility of the leaching solution. In carrying out the invention, a foam bank is either introduced into the ore bed of developed in-situ in the ore bed. The foam then becomes a diverting agent forcing the leaching fluid through the previously non-contacted regions resulting in increased mineral values recovery.

DESCRIPTION OF THE SPECIFIC EMBODIMENTS

In the following description and examples the invention will be described in connection with the recovery of uranium values by the solubilization thereof from uranium bearing ores. However, it should be clear that the invention is applicable to the solution mining of other mineral values capable of forming soluble reaction products with carbonated leaching solutions. Thus, for example, substances such as vanadium, molybdenum, nickel, copper, the rare earths and the like are recovered using the process of the present invention.

Uranium minerals frequently occur in the highly siliceous rocks and sedimentary deposits, generally as a mixture of the insoluble quadrivalent form and the soluble sexivalent form. In solution mining processes, an oxidizing agent is utilized to contact the mineral deposit to oxidize the uranium to its soluble sexivalent form. The deposit is then contacted with a leaching solution to solubilize the sexivalent uranium, which is extracted with the solution. The oxidation of the uranium can be carried out as a separate step or simultaneously with the leaching step by dissolving the oxidizing agent in the leaching solution.

Conventionally, the leaching solution is brought into contact with the subterranean deposit by injection into one or more injection wells which penetrate the deposit. The leaching solution is introduced into the injection well under sufficient pressure to force it out of the well bore into the adjacent deposit. Continued injection of leaching solution drives the solution through the deposit to one or more spaced-apart production wells where the solution is recovered for subsequent extraction of the mineral values. The number of injection and production wells and the spacing therebetween can vary depending upon the nature of the formation. Additionally, the pattern of injection and production wells can also vary although a typical pattern is the five-spot pattern consisting of a centrally disposed recovery well and four injection wells spaced around the recovery well. Althernatively, a given volume of leaching solution can be injected into a well to percolate into the surrounding formation. Following the injection phase, the well is pumped out the injected leaching solution is recovered from the same well into which it had been injected.

The present invention is applied to a method for improving the recovery of uranium from a subterranean ore body subjected to in-situ leaching by alterning the flow behavoir of the leaching solution. In many ore deposits the strata are sufficiently heterogeneous as to severely alter flow patterns of the leaching solution. Leaching fluids follow the higher permeability streaks thus by-passing portions of the ore body. Tests show that in many reservoirs 30 to 50% or more of uranium ore values may not be recoverable via in-situ leaching because of channeling of leachate through the high permeability zones. This is especially true in a formation having a low permeability matrix which has been extensively fractured or which has high permeability streaks running through the basic formation matrix. In such a situation, the fractures or streaks have a permeability which is quite high and is drastically different from the unfractured or base matrix.

It can thus be seen that the known recovery processes depend a great deal on the fairly uniform permeability of a formation. It has been found that selective plugging of higher permeability zones results in a more efficient sweep of the reservoir. Foam can be effectively used as a blocking agent because of its high resistance to flow when placed in a porous medium such as a formation. This phenomenon known as Jamin Effect substantially reduces the flow of foam through a porous medium. Jamin Effect occurs because of a tendency for gas bubbles to lodge in the restrictions of a porous media which greatly impairs or terminates flow through the media. Accordingly, foam can be successfully used as a blocking agent, thus diverting the leaching fluids through the previously non-contacted regions resulting in increased uranium recovery.

The foam is obtained by intimately contacting a foaming agent solution with a compatible gas. The foaming agent solution comprises foaming agents and water. Examples of foaming agents are surfactants which include the various nonionic, cationic and anionic surfactants. The foaming agent needed can be of the type where, upon the introduction of a compatible gas, a foam that possesses stability for some time without immediate collapse is subsequently developed. Both surfactant type and concentration are to be compatible with the particular ore bed and the requirements of the treatment facilities where uranium is extracted from the leaching solution. Examples of gases compatible in a majority of reservoirs include air, nitrogen, natural gas, combustion products of natural gas (also referred to as flue gases), carbon dioxide, low molecular weight hydrocarbons, carbon monoxide, oxygen, mixtures of the above and like materials. The gas is preferably in a substantially gaseous state of reservoir conditions, i.e., reservoir temperature and pressure.

A suitable leaching solution is one that utilizes oxgen and bicarbonates. The bicarbonate is formed in-situ by the injection of caustic into the formation followed by the injection of carbon dioxide. The bicarbonate is monitored so as to keep the pH of the leachate at 7.2 to 9.0. The oxygen conecentration is usually at saturation which varies with the bottom hole pressure of the injection well. For example, some New Mexico uranium wells are drilled to about 2000 ft. which would yield a bottom hole pressure of about 800 psi thus resulting in oxygen saturation at about 1000 p.p.m. On the other hand, some Texas uranium wells are drilled to 400 ft. which would yield a bottom hole pressure of about 175 PSI thus resulting in oxygen saturation at about 350–400 p.p.m. A suitable acidic leaching solution is that disclosed in U.S. Pat. No. 4,105,253 to Showalter which is hereby incorporated by reference. In the above patent, carbon dioxide is admixed with water to form a carbonic acid solution for use as a leaching solution for extraction of uranium by solution mining. An oxidizing agent, preferably oxygen, is also present in the solution. The above are mere examples and should not be considered as limiting on the present invention.

One aspect of the invention is demonstrated by the following. In an in-situ leaching operation, a lixiviant is introduced into a subterranean uranium ore deposit through a suitable injection system. The lixiviant may be an acidic or alkaline medium which solubilizes uranium values as it traverses the ore body. The pregnant lixiant is then withdrawn from the ore body through a production system and treated to recover uranium therefrom by suitable tecniques such as solvent extraction, direct precipitation or by absorption and elution employing an ion exchange resin. If the formation does not have a substantially uniform matrix, then channeling of the lixiviant occurred, thus by-passing regions of the ore. A foaming agent solution, consisting of a foaming agent and water, is introduced into the formation with or prior to additional leaching solution. The solution will flow through the previously leached higher permeability zones. A compatible gas is introduced to create a foam in the higher permeability zones of the formation. The leaching solution introduced after the foam is formed will traverse the previously unswept regions thus solubilizing more uranium. This result is accomplished because of the substantial blocking of the formation higher permeability zones by the foam and the creation thereby of a higher pressure drop in these zones than in the denser zones. After the production cycle, additional cycles of foaming and production can be utilized until such operations become uneconomical.

Although the foam may be generated on the surface and then injected through or by the injection means into the formation, it is preferred that the foam be generated in the formation because of the normally several adverse effects which result if the foam is created at the surface. When foam is created at the surface, it is generated at a low pressure and upon being subjected to a high pressure such as in the formation, it frequently undergoes changes that reduce its effectiveness. Additionally, it is often very difficult to pump a foam into a wellbore and force it into a formation, due to its high resistance to flow.

Generally, when generating the foam in-situ, generation will occur in the area of the well bore of the injection well. If, however, it is desired to generate the foam at a point removed from the well bore, this may be accomplished by injecting the foaming agent solution into the formation and displacing it a distance from the well bore to the point at which foam generation is desired. Thereafter, the foam-producing gas is injected into the formation and comes into contact with the displaced foaming agent solution, thus generating the foam at the desired point.

In many cases, the uranium in the subterranean deposit exists in the tetravalent state. Thus, it is a conventional practice in both acid and alkaline leaching to employ an oxidizing agent to ensure that the uranium is oxidized to or retained in the hexavalent state at which it is solubilized by the lixiviant. The present invention is particularly applicable to the processes employing a leaching solution with an oxidant in a gaseous phase, for example, carbon dioxide/oxygen, introduced in an aqueous solution. A quantity of foaming agent solution is introduced along with the leaching solution to develop a foam bank in-situ in the ore bed as the gas comes out of the leaching solution. Additional gas, above the saturation requirements of the leaching solution, may be injected along with the foaming agent to initiate a foam bank at an earlier stage or to maintain an already existing foam bank. Presence of the increased number of interfaces increases the resistance to flow (Jamin Effect) because of the increased pressure drop. The foam then becomes a diverting agent forcing the leaching fluid through the previously non-contact regions resulting in increased uranium recovery.

The present invention is also applicable in fairly uniform beds of appreciable thickness. When a leaching solution containing a gaseous oxidant is introduced into fairly uniform beds of appreciable thickness, it is possible for a portion of the gas to come out of solution as the pressure is decreased along the flow path, and by gravity segregation, the gas would tend toward the top of the zone leaving a partially barren liquid phase in the lower section. This problem is solved by injecting a foaming agent with the leaching solution and when such pressure drop zones are encountered, a foam is formed as the gas comes out of solution. Due to the Jamin Effect, the foam will act to divert the leaching solution away from such zones and thus eliminating the problem of further gas separation.

As can be seen from the above situations, foam can be used in many ways to divert the flow of a leaching solution. Such selective manipulation will result in better sweep efficiency and thus better uranium recovery. The above methods can be used in any well engineering pattern and the foaming agent, and compatible gas were appropriate, can be injected continuously, in a finite slug or several slugs. Additional cycles of foaming and production can be utilized until such operations become uneconomical. An advantage to the above processes is that the blocking effect can be temporary. Elimination of either the foaming agent or the gas from the injection fluids allows the foam to dissipate thus restoring the beds to the original conditions, which will enhance restoration efforts.

Although the present invention has been described with preferred embodiments, it is to be understood that modifications and variations may be resorted to, without departing from the spirit and scope of this invention, as those skilled in the art will readily understand. Such modifications and variations are considered to be within the purview and scope of the appended claims.

What is claimed is:

1. An improved process for the recovery of mineral values from a subterranean deposit, having heterogeneous permeability zones, penetrated by injection and production systems, comprising:

a. introducing into said deposit via said injection system a lixiviant containing a leaching agent, foaming agent, and dissolved gaseous oxidant;

b. displacing said lixiviant through said subterranean deposit to solubilize mineral values therein;

c. producing pregnant lixiviant containing mineral values from said production system; and d. recovering mineral values from said pregnant lixiviant.

2. The process of claim 1 wherein said mineral is uranium.

3. An improved process for the recovery of mineral values from a subterranean deposit of substantially uniform permeability beds of appreciable thickness, said deposit penetrated by injection and production systems, the process comprising:

a. introducing into said deposit via said injection system a lixiviant containing a leaching agent, foaming agent, and dissolved gaseous oxidant;

b. displacing said lixiviant through said subterranean deposit to solubilize mineral values therein;

c. producing pregnant lixiviant containing mineral values from said production system; and d. recovering mineral values from said pregnant lixiviant.

4. The process of claim 3 wherein said mineral is uranium.

5. An improved process for the recovery of mineral values from a subterranean formation having substantially varied permeability zones and penetrated by injection and production systems, wherein oxidation of the mineral values is advantageous in enhancing their solubility, comprising the steps of:

(a) introducing into and displacing through the formation a lixiviant containing a leaching agent, a foaming agent, and an oxidant wherein at least the leaching agent or the oxidant is dissolved gaseous material and wherein said gaseous material is present in sufficient amounts and under sufficient pressure such that when a substantially higher permeability zone is encountered, the gaseous material is released from the lixiviant causing the formation of foam which diverts further fluid flow from the higher permeability zone;

(b) producing pregnant lixiviant containing mineral values from said production system; and (c) recovering mineral values from said pregnant lixiviant.

6. The process of claim 5 wherein the oxidant is selected from the group consisting of oxygen, air, oxygen-containing gas or any combination thereof.

7. The process of claim 5 wherein the mineral values are uranium values.

8. The process of claim 7 wherein the leaching agent is a carbonate/bicarbonate system.

9. The process of claim 8 wherein the carbonate/bicarbonate leaching agent is obtained by solubilizing carbon dioxide in water.

10. An improved process for the recovery of uranium values from a subterranean formation having substantially varied permeability zones and penetrated by injection and production systems, wherein oxidation of the uranium values is advantageous in enhancing their solubility, comprising the steps of:

(a) introducing into and displacing through the formation a carbonate/bicarbonate lixiviant additionally containing a foaming agent and an oxidant wherein the oxidant is dissolved gaseous material and wherein said oxidant is present in sufficient amounts and under sufficient pressure such that when a substantially higher permeability zone is encountered, the gaseous material is released from the lixiviant causing the formation of foam which diverts further fluid flow from the higher permeability zones;

(b) producing pregnant lixiviant containing uranium values from said production system; and (c) recovering uranium values from said pregnant lixiviant.

11. The process of claim 10 wherein the oxidant is selected from the group consisting of oxygen, air, oxygen-containing gas or any combination thereof.

12. The process of claim 10 wherein the carbonate/bicarbonate lixiviant is obtained by solubilizing carbon dioxide in water.

* * * * *